US006758708B2

(12) United States Patent
Angelini

(10) Patent No.: US 6,758,708 B2
(45) Date of Patent: Jul. 6, 2004

(54) SWIM FIN WITH ENERGY STORAGE AND RELEASE SYSTEM FOR IMPROVED ANGLE OF ATTACK AND WATER FLOW CHARACTERISTICS

(75) Inventor: Sergio A. Angelini, San Diego, CA (US)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 10/184,231

(22) Filed: Jun. 28, 2002

(65) Prior Publication Data

US 2004/0002271 A1 Jan. 1, 2004

(51) Int. Cl.[7] ..... B63B 31/11
(52) U.S. Cl. ..... 441/64
(58) Field of Search ..... 441/64

(56) References Cited

U.S. PATENT DOCUMENTS

| | | | | | |
|---|---|---|---|---|---|
| 3,019,458 | A | | 2/1962 | De Barbieri et al. | 9/309 |
| 3,665,535 | A | | 5/1972 | Picken | 9/304 |
| 4,209,866 | A | * | 7/1980 | Loeffler | 441/64 |
| 4,657,515 | A | | 4/1987 | Ciccotelli | 441/64 |
| 4,737,127 | A | | 4/1988 | Lamont | 441/64 |
| 4,775,343 | A | | 10/1988 | Lamont et al. | |
| 4,869,696 | A | | 9/1989 | Ciccotelli | 441/61 |
| 4,934,971 | A | | 6/1990 | Picken | 441/64 |
| 5,746,631 | A | | 5/1998 | McCarthy | 441/64 |
| 6,050,868 | A | | 4/2000 | McCarthy | 441/64 |
| 6,095,879 | A | | 8/2000 | McCarthy | 441/64 |
| 6,126,503 | A | * | 10/2000 | Viale et al. | 441/64 |
| 6,146,224 | A | | 11/2000 | McCarthy | 441/64 |
| 6,364,728 | B1 | * | 4/2002 | Viale et al. | 441/64 |
| 6,371,821 | B1 | | 4/2002 | McCarthy | 441/64 |
| 6,413,133 | B1 | | 7/2002 | McCarthy | 441/64 |

FOREIGN PATENT DOCUMENTS

| | | | |
|---|---|---|---|
| DD | 259 353 A1 | | 8/1988 |
| DE | 3438808 A1 | | 4/1986 |
| EP | 0 308 998 | | 2/1993 |
| EP | 1 082975 | | 3/2001 |
| FR | 787.291 | | 12/1934 |
| FR | 1.245.395 | | 1/1960 |
| FR | 1 344 379 | | 11/1963 |
| FR | 1.501.208 | | 11/1966 |
| FR | 2.058.941 | | 5/1971 |
| FR | 2.213.072 | | 8/1974 |
| FR | 2.574.748 | | 6/1986 |
| GB | 234305 | | 5/1925 |
| GB | 476092 | | 12/1937 |
| GB | 1 284 765 | * | 8/1972 |
| JP | 61-6097 | | 1/1986 |
| JP | 62-134395 | | 6/1987 |

OTHER PUBLICATIONS

Michael S. Triantafyllou and George S. Triantafyllou, An Efficient Swimming Machine, Scientific American, Mar. 1995 (7 pages).

U.S. patent application Publication US 2001/0044246 A1, dated Nov. 22, 2001, Inventor Peter T. McCarthy, entitled High Efficiency Hydrofoil and Swim Fin Designs (55 pages).

Michael S.

* cited by examiner

*Primary Examiner*—Sherman Basinger
(74) *Attorney, Agent, or Firm*—Foley & Lardner LLP

(57) ABSTRACT

A swim fin and a method providing thrust from a kick by a swimmer are disclosed. The swim fin includes a swim fin for use by a swimmer comprising a foot pocket adapted to receive a foot of the swimmer; a blade extending from the foot pocket; a biasing system configured to allow the blade to bend within a narrow range of angles of attack under a wide range of loads. The method comprises providing a swim fin comprising a foot pocket, a blade, and one or more non-linear ribs that extend generally perpendicular to the blade. The method also comprises bending the blade relative to the foot pocket about an axis and controlling the bending of the blade by providing varying resistance by the non-linear ribs.

39 Claims, 5 Drawing Sheets

SWIM FIN WITH ENERGY STORAGE AND RELEASE SYSTEM FOR IMPROVED ANGLE OF ATTACK AND WATER FLOW CHARACTERISTICS

FIELD OF THE INVENTION

The present invention relates to a swim fin with improved angle of attack control and water flow characteristics. More particularly, the present invention relates to a swim fin with a biasing element configured to provide improved angle of attack at various kicking power levels, and to a swim fin with flow channels to provide improved water flow characteristics.

BACKGROUND OF THE INVENTION

Swim fins are generally known and typically include a foot pocket and a blade portion. A desirable feature of a swim fin is that the blade portion of the fin easily attains a correct "angle of attack" during use. The angle of attack is the relative angle that exists between the actual alignment of the oncoming flow (i.e., direction of motion of the swimmer) and the lengthwise alignment of the blade of the fin. A "correct" angle of attack optimizes the conversion of kicking energy of the swimmer to thrust or propulsion through the water. When this angle is small, the blade is at a low angle of attack. When this angle is high, the blade is at a high angle of attack. As the angle of attack increases, the flow collides with the fins attacking surface at a greater angle. This increases fluid pressure against this surface.

Conventional fins tend to assume different curvatures or attack angles according to the direction of movement and the magnitude of the forces applied during use (i.e., the kicking energy or power). Therefore, it is generally known to design a swim fin to provide a particular angle of attack for a particular kick power. For example, such known swim fins are typically designed for either light kicking, medium kicking, or hard kicking. One way to design a fin for one of these particular kicking powers is by the composition of the material (e.g., stiff material for hard kicking, flexible or soft material for light kicking, etc.). Changing the composition of the material, however, does not efficiently or adequately control the angle of attack, is difficult to match or "size" to the strength of the swimmer, and requires the swimmer to use the "prescribed" kicking power for that particular fin. Also, most existing fins can only reach a compromise in that they are either stiff, soft, or somewhere in between. When conventional fins are designed for hard kicking (e.g., made of stiff material), they reach the correct angle of attack when kicked very hard. On a normal, relaxed kick they don't bend far enough and this negatively affects the performance. Fins of this kind will be uncomfortable on the legs, strenuous and with poor performance on a relaxed dive. When conventional fins are designed for light kicking (e.g., made of soft material), they reach the correct angle of attack when kicked very gently. With a strong kick, such as when swimming in a current or needing to get up to speed, the blade is overpowered and there is little or no thrust available. Fins like this might be comfortable on a relaxed dive, but could become unsafe by not being able to provide the thrust to overcome a slight current. When conventional fins are somewhere in between, they can be overpowered when kicked real hard, are still uncomfortable when kicked gently, but cover a wider range of useful kicking power.

When such known fins are used outside their prescribed kicking power, the angle of attach tends to be too low or too high. When the fin blade is at an excessively high or low angles of attack, the flow begins to separate, or detach itself from the low pressure surface of the fin. This tends to cause the fin to be less efficient. Another problem that occurs at higher angles of attack is the formation of vortices along the outer side edges of the fin. This tends to cause drag. Drag becomes greater as the angle of attack is increased. This reduces the ability of the fin to create a significant difference in pressure between its opposing surfaces for a given angle of attack, and therefore decreases the power delivered by the fin.

Accordingly, it would be advantageous to provide a swim fin that provides a desired or optimum angle of attack for a variety or range of kicking strengths or powers. It would further be desirable to provide a swim fin in which the angle of attack is accurately controlled both for the upstroke and for the downstroke so that the ratio of power to fin area is markedly increased (which makes it possible to reduce the overall size of the swim fin without sacrificing total power) for various kicking efforts. It would further be advantageous to control the angle of attack by structural characteristics of bending, not merely by characteristics of materials. It would further be desirable to provide a swim fin with biasing members such as integrally molded, sinusoidally shaped ribs that increase the performance by controlling the angle of attack and converting a higher percentage of the kick energy into thrust. It would further be advantageous to provide a swim fin with flow channels that reduce spillover and provides improved water flow characters. It would further be desirable to provide for a swim fin having one or more of these or other advantageous features.

To provide an inexpensive, reliable, and widely adaptable swim fin with improved angle of attack and water flow characteristics that avoids the above-referenced and other problems would represent a significant advance in the art.

SUMMARY OF THE INVENTION

The present invention relates to a swim fin for use by a swimmer. The fin comprises a foot pocket adapted to receive a foot of the swimmer, a blade extending from the foot pocket, and a biasing system configured to allow the blade to bend within a narrow range of angles of attack under a wide range of loads.

The present invention also relates to a swim fin for use by a swimmer. The fin comprises a foot pocket adapted to receive a foot of the swimmer, a blade extending from the foot pocket, a biasing system configured to control the angle of attack of the blade. The biasing system comprises one or more biasing members such as a sinusoidal shaped rib.

The present invention further relates to a swim fin for use by a swimmer. The fin comprises a foot pocket adapted to receive a foot of the swimmer, a blade extending from the foot pocket, and means for controlling flexing of the blade.

The present invention further relates to a method of providing thrust from a kick by a swimmer. The method comprises providing a swim fin comprising a foot pocket, a blade, and one or more non-linear ribs that extend generally perpendicular to the blade. The method also comprises bending the blade relative to the foot pocket about an axis and controlling the bending of the blade by providing varying resistance by the non-linear ribs.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

Figure 1:
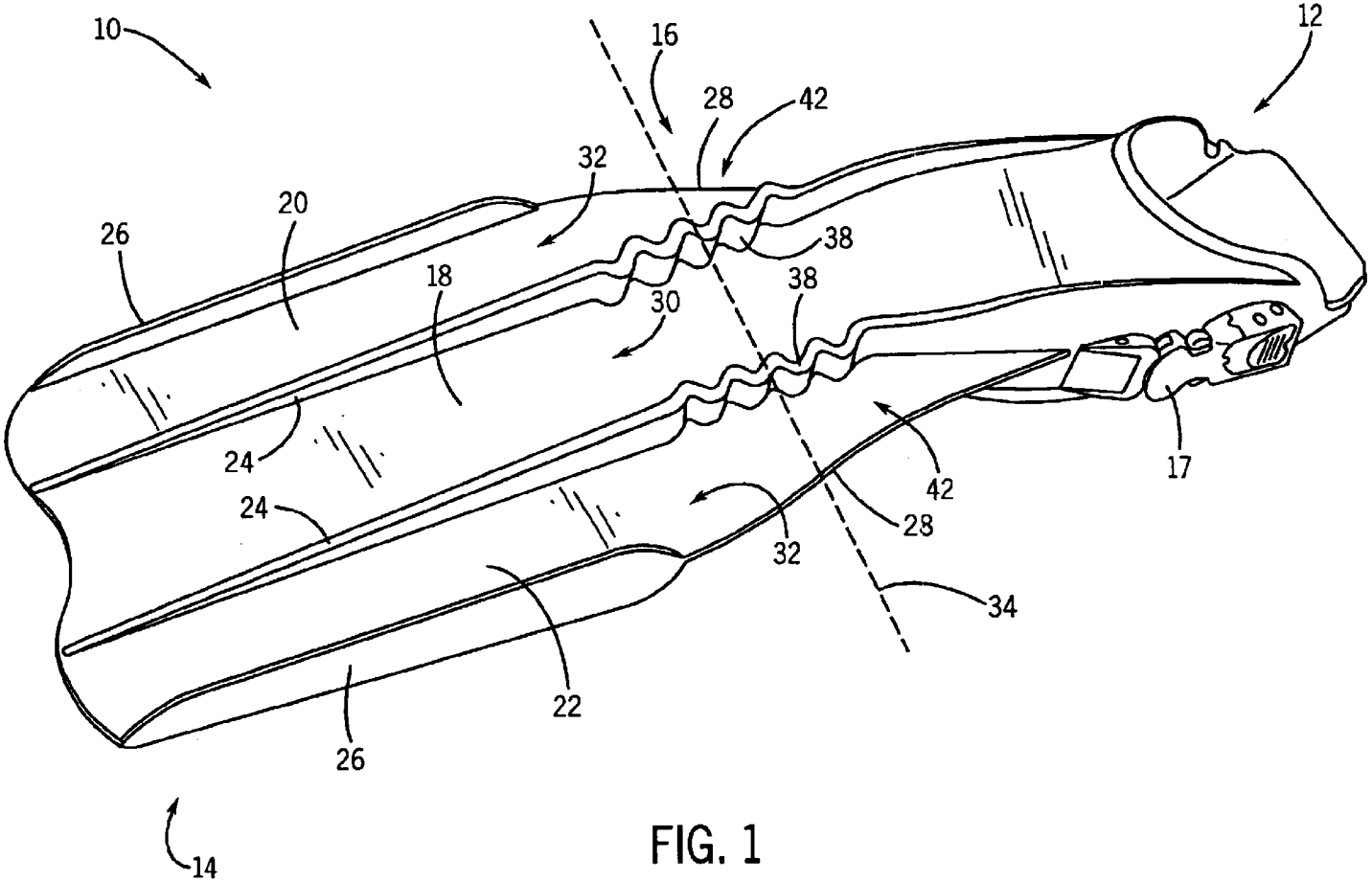
FIG. 1 is a top perspective view of a swim fin according to a preferred embodiment.

Before explaining a number of preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF PREFERRED AND OTHER EXEMPLARY EMBODIMENTS

Referring to FIG. 1, a pair of swim fins 10 are shown according to a preferred embodiment. Each fin 10 comprises a foot pocket 12, a blade 14, and an energy accumulation and biasing system 16 configured to maintain blade 14 in the desired angle of attack for a variety or range of kicking strengths or powers.

According to a preferred embodiment, foot pocket 12 and blade 14 are fused together to form an integral structure. Alternatively, foot pocket 12 and blade 14 are integrally molded (e.g., in a single molding operation). Foot pocket 12 is shown with an open heel and buckles 17 for attachment of conventional heel straps (shown in FIG. 3). Alternatively, foot pocket 12 includes a closed heel instead or any of a variety of conventional designs. Foot pocket 12 is preferably formed of a material having a different stiffness than blade 14. For example, if the preferred material for blade 14 is stiff, the material for foot pocket 12 may be softer for increased comfort of the diver.

Blade 14 comprises a composite ribbed framework. The ribbed framework is configured to provide stiffness to blade 14 and channel water flow across fin 10. The framework includes a plurality of segments shown in the FIGURES as a central or main segment 18 and two projecting lateral segments 20, 22 defined by a plurality of longitudinally extending ribs (shown as inner ribs 24 and outer ribs 26) that extend generally along the longitudinal axis of fin 10. Lateral segments 20, 22 of the blade 14 have leading edges 28 that slant rearwardly, and configured to smoothly divide the onflowing water. Inner ribs 24 extend along the sides of foot pocket 12 rearwardly to the end of blade 14, and are configured to provide structure and rigidity to fin 10.

Outer ribs 26 extend along a portion of the outer sides of lateral segments 20, 22 of blade 14. Outer ribs 26 are configured to minimize the obstruction to water by being parallel to the direction of flow with minimal cross section to the flow itself, to prevent energy loss by reducing spill-over effect, and to increase performance by stiffening blade 14 itself. Whereas a conventional fin design allows for a progressive bending of the entire blade to somewhat accommodate a wider range of kicking powers, a preferred embodiment of the present invention focuses the bending action around the biased elements 16, thus maintaining the blade as a rigid and substantially "straight" structure, the consequence of a conventional progressively bending blade is also that the angle of attack progressively varies, whereas a straight blade (as used in the preferred embodiment) maintains a more constant angle of attack. (The outer ribs on conventional fins connect to the foot pocket to provide stiffness to the fin). According to a particularly preferred embodiment, the rearward portions of inner ribs 24 are tapered and (to a slight degree) downwardly angled, and frontal edges of the outer ribs 26 are curved to reduce flow resistance.

An inner flow channel 30 is defined by inner ribs 24 and the surface of foot pocket 12 and blade 14. Outer flow channels 32 are defined by inner ribs 24, outer ribs 26, and the surface of foot pocket 12 and/or blade 14. The parallel disposition of inner and outer ribs 24, 26 provides inner and outer flow channels 30, 32 that are generally uniform along the length of fin 10. Alternatively, inner and outer flow channels 30, 32 are non-uniform along their length (e.g., narrows, broadens, varying, etc.). As the swimmer (or snorkeler or diver) propels her/himself, water passes along the sides, top and bottom of foot pocket 12. The flowing water need not traverse ribs interposed in its path as it flows along blade 14. As such, fin 10 is configured to minimize the resistance to flow and the dissipation of swimmer's energy due to turbulence.

According to a preferred embodiment, blade 14 is relatively rigid or stiff so that flexing substantially occurs about an axis 34 at a particular region of fin 10. As such, blade 14 remains essentially flat during use and provides a regular planar surface to interact with the water flow. Preferably, inner and/or outer ribs 24, 26 are configured to provide additional support and rigidity to blade 14. By maintaining a substantially flat blade 14, the angle of attack is optimized along substantially the entire length of blade 14 (e.g., providing substantially a single angle of attack), and not merely at one location (as may be the case with a relatively flexible blade which tends to have a continuously varying angle of attack). The increased efficiency derived from the use of a rigid fin and from the use of flow channels of uniform area permits the design of a more "powerful" fin having a relatively short fin part.

According to a preferred embodiment, biasing system 16 is configured to provide an optimum angle of attack for a variety or range of kicking powers. By controlling the angle of attack, biasing system 16 is configured to increase performance and efficiency of fin 10 by converting a higher percentage of the kick energy into thrust.

According to an exemplary embodiment, biasing system 16 gradually increase the resistance to flexing or bending of fin 10 as a function of the degree of bending itself. The difference between a soft kick and a hard kick is the amount of effort provided by the swimmer and the energy transferred from the leg to the fin and from there to the water. Typically the harder the kick, the more energy transferred to fin 10, and the more fin 10 wants to bend. Biasing system 16 will bend fin 10 within a narrow range of angles of attack under a wide range of loads (i.e., kick strengths or powers). As such, the angle of attack is configured to not significantly vary under differing load conditions (e.g., between a soft kick and a hard kick). Such control of the angle of attack also provides for the concentration and storage of the difference in energy between a soft and a hard kick in the biasing element 16 of fin 10. These particular sections will at first accumulate the excess energy and later on release it and transfer it to the water for a high efficiency forward thrust. This energy accumulation is achieved with a small change in degree of bending of blade 14 so when fin 10 is kicked gently, it approaches the optimal angle of attack, and when kicked harder, the angle of attack is increased only slightly (but remains near the optimum angle of attack) as biasing system 16 absorbs and/or stores the additional energy.

Figure 2:
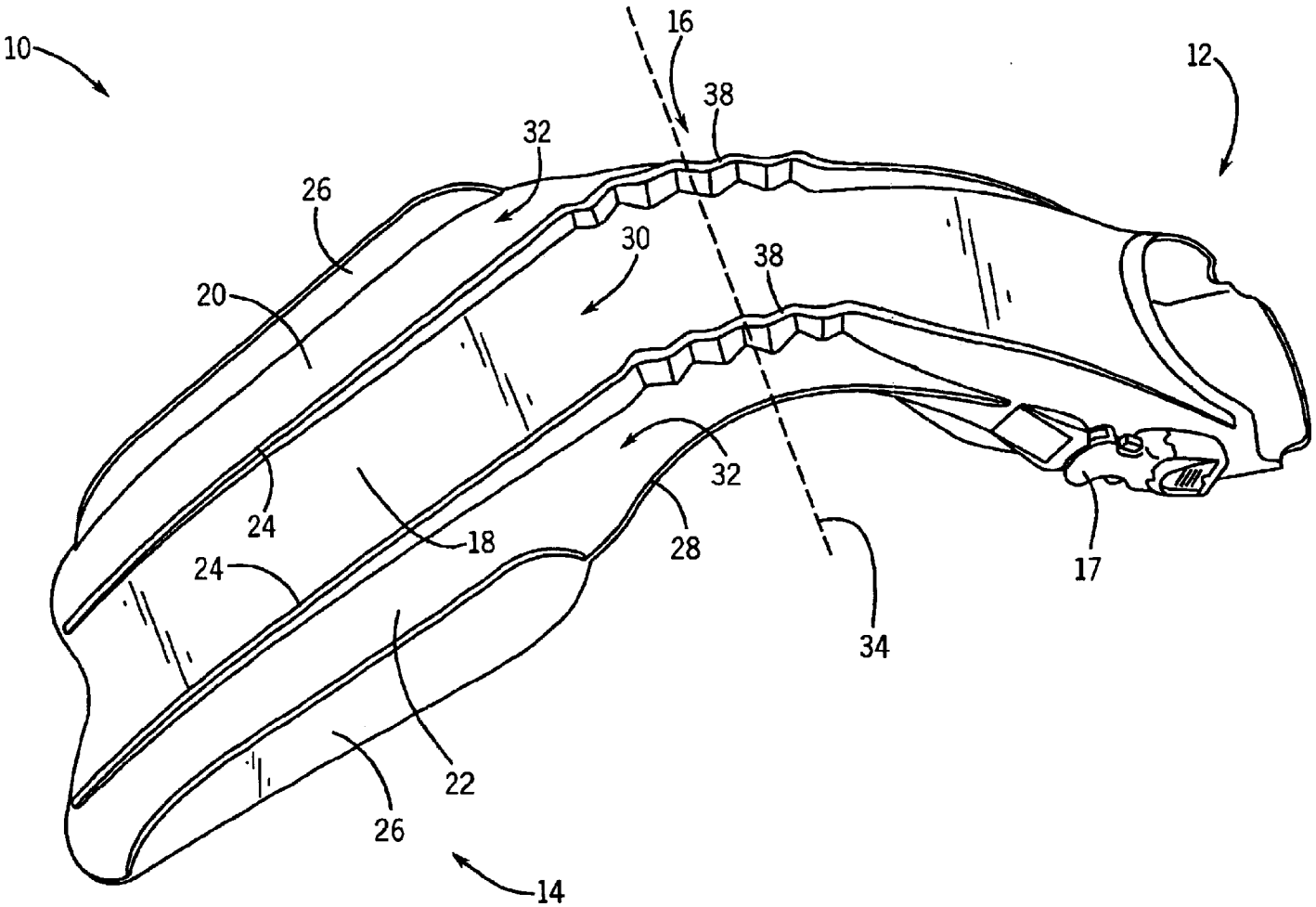
FIG. 2 is a top perspective view of the swim fin of FIG. 1 with the blade flexed downward.
Figure 3:
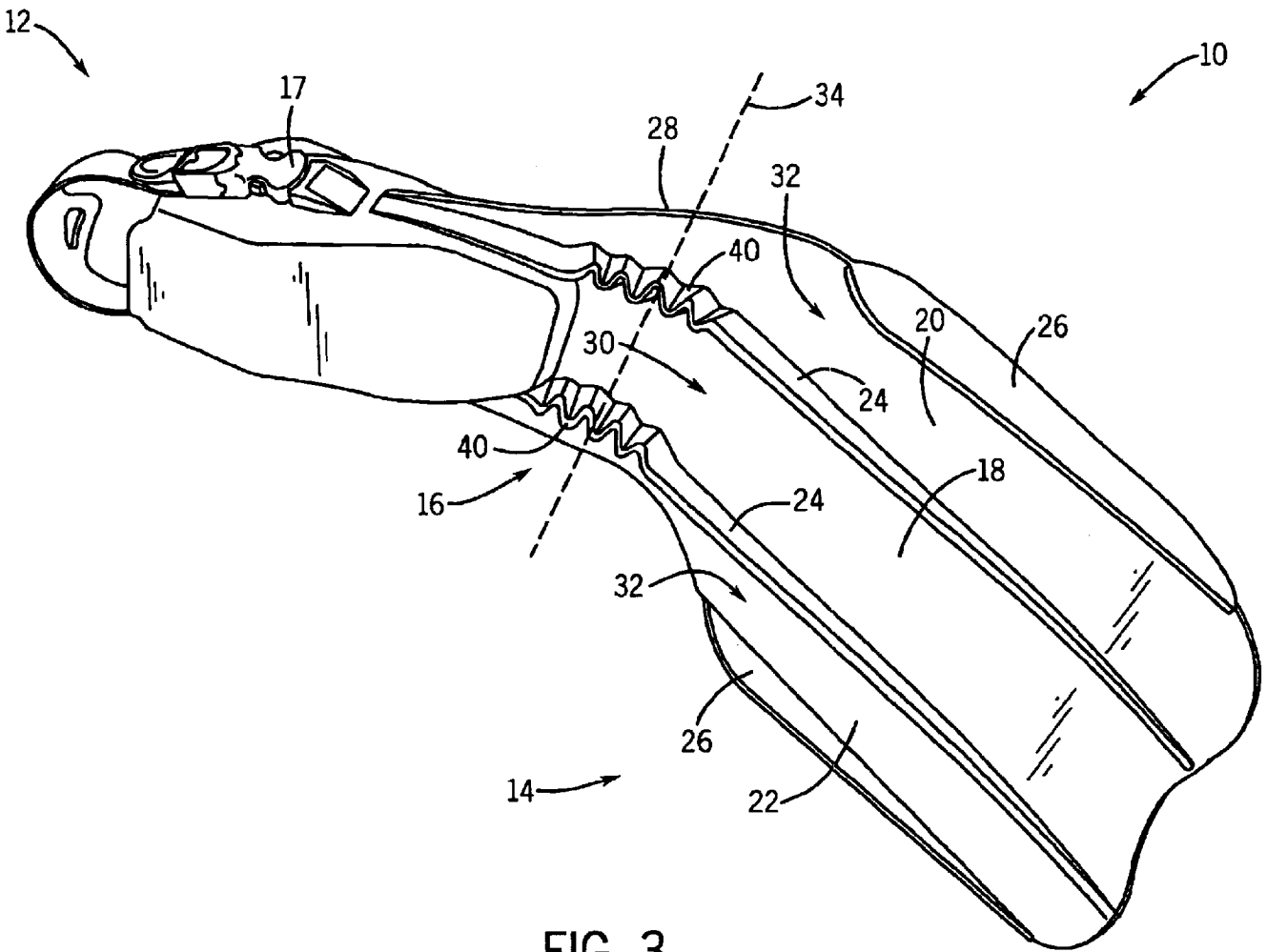
FIG. 3 is a bottom perspective view of the swim fin of FIG. 2.
Figure 4:
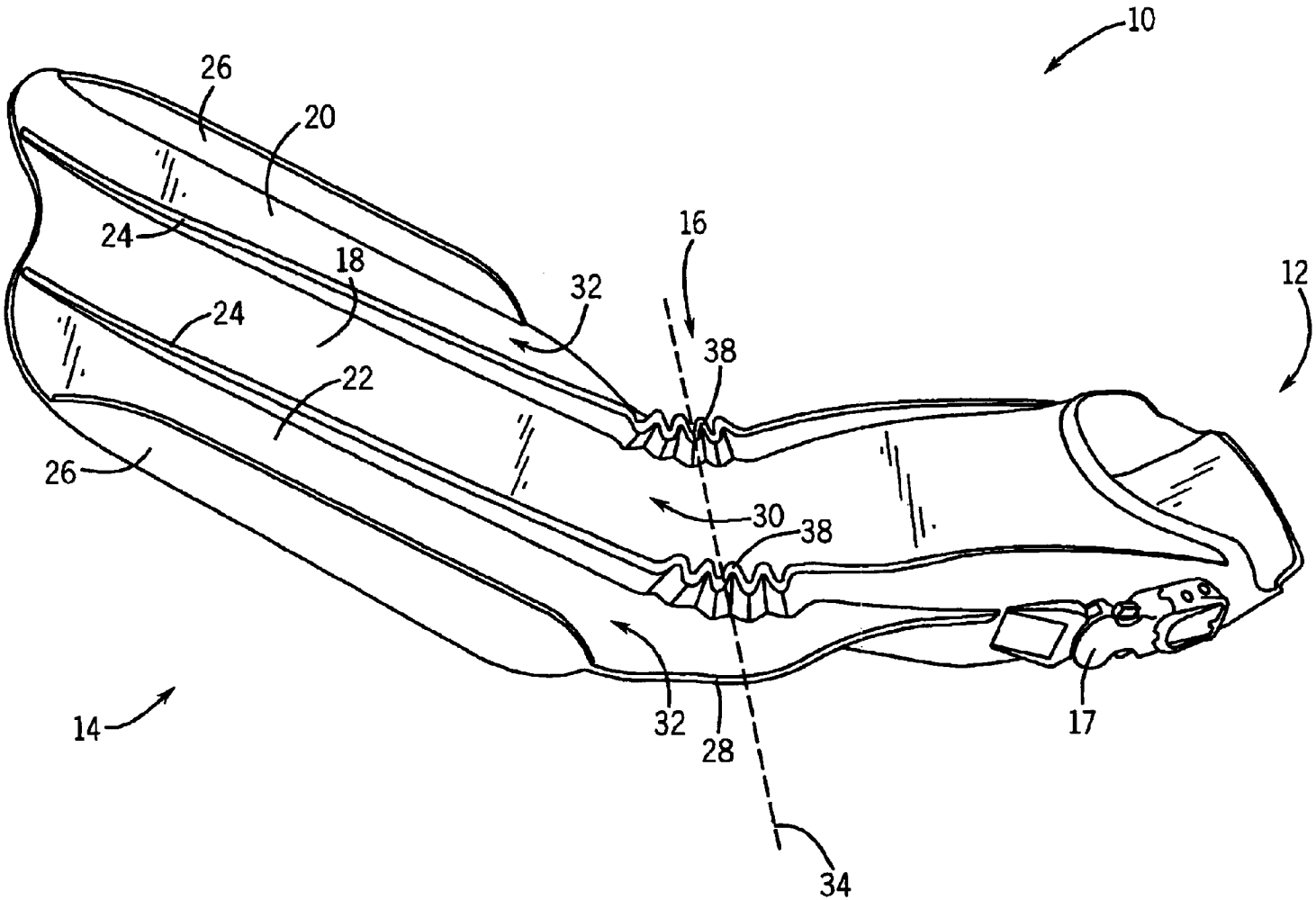
FIG. 4 is a top perspective view of the swim fin of FIG. 1 with the blade flexed upward.
Figure 5:
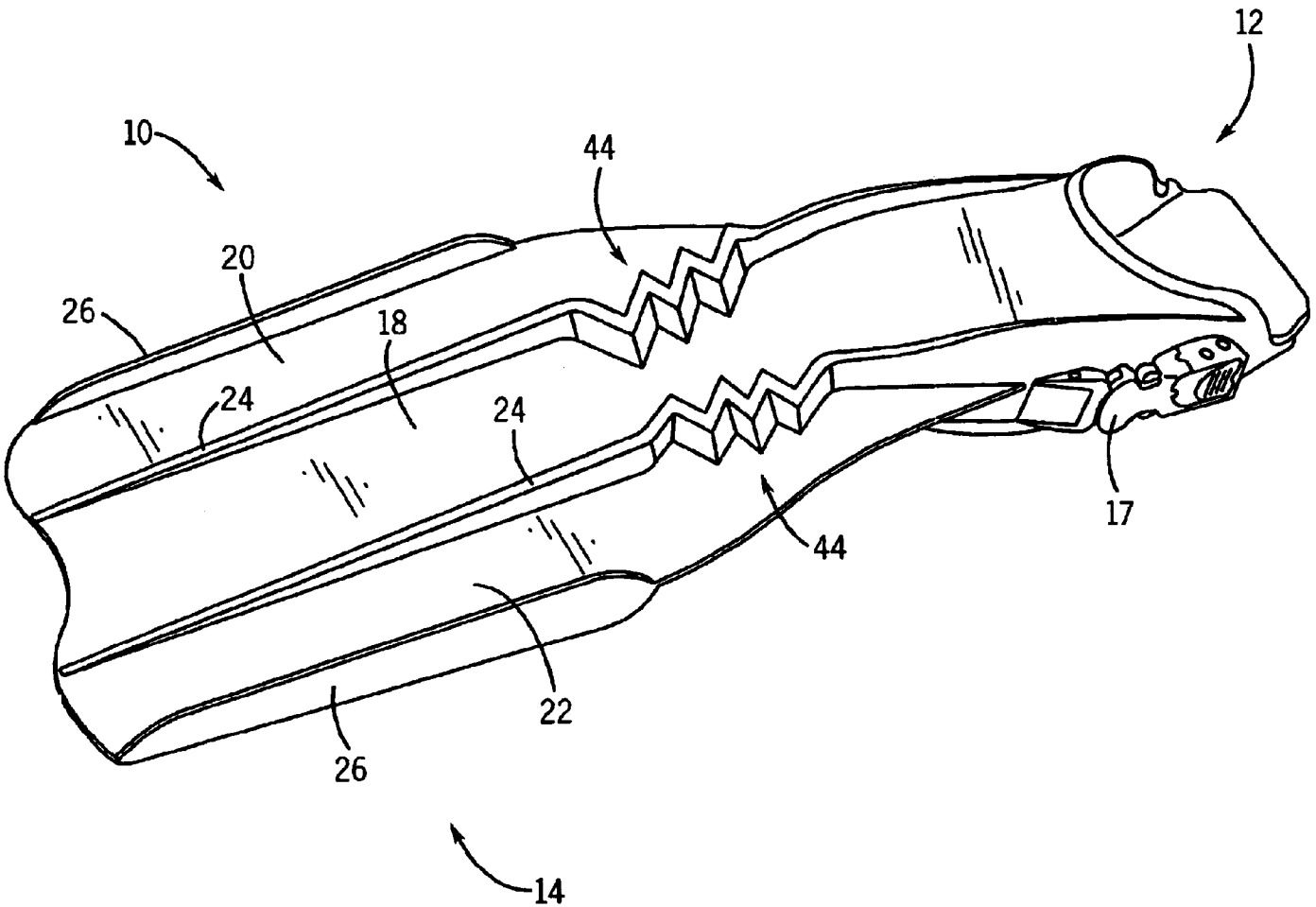
FIG. 5 is a top perspective view of a swim fin according to an exemplary alternative embodiment.

According to a preferred embodiment, biasing system 16 includes one or more sinusoidally-shaped ribs proximate flexing axis 34. As shown in FIGS. 2–4, flexing axis 34 is located in the portion of fin 10 that connects foot pocket 12 with the blade 14 (e.g., upper ribs 38 on top portion of fin 10, and lower ribs 40 on bottom portion of fin 10). According to an alternative embodiment shown in FIG. 5, upper ribs 44 and lower ribs (not shown) comprise alternating, traversing linear segments (e.g., non-arcuate). According to yet other alternative embodiments, upper and lower ribs 38, 40 are any of a variety of biasing designs (e.g., springs), dimensions, configurations, and orientations.

Upper and lower ribs 38, 40 provide a spring constant, which is defined by the period, amplitude, material, wall thickness, and the like of upper and lower ribs 38, 40. Preferably, this spring constant is constant and "tuned" to provide a particular desired performance. According to a particularly preferred embodiment, the period or wavelength of upper and lower ribs 38, 40, is about one inch and has a wall thickness of about 0.3 inches at its base and tapers to about 0.15 inches at its top. According to an alternative embodiment, biasing system 16 is configured to provide a variable spring constant (e.g., by varying the period, frequency, or the like at various portions of biasing system 16).

Referring to FIG. 1 in a non-stressed configuration, upper and lower ribs 38, 40 are "neutral" (i.e., unstressed, not biased, unstrained, etc.). A downward kick (a horizontally swimming diver that kicks downwards) bends blade 14 upwards. Referring to FIG. 2 when fin 10 bends under the action of the kick, upper ribs 38 on the top of foot pocket 12 tend to stretch due to the bending action. Similarly, lower ribs 40 on the bottom tend to compress, as shown in FIG. 3. When the kick is reversed (as shown in FIG. 4), the upper ribs 38 reverse the role with the lower ribs 40 and the whole process repeats symmetrically. According to an alternative embodiment, sinusoidally-shaped upper and lower ribs 38, 40 are located on only one side of the fin (e.g., the side that typically provides the most thrust).

According to a preferred embodiment, upper and lower ribs 38, 40 are made from an elastic material such that the more it stretches, the more resistance it will give. As such, the more blade 14 of fin 10 wants to bend, the higher the resistance given by the stretching upper ribs 38. Similarly, as bending of blade 14 increases, lower ribs 40 tend to compress more and will increasingly resist this compression. By deforming upper and lower ribs 38, 40 the energy is being spent to deform these sections of fin 10 rather than flexing fin 10 past its optimum angle of attack. This energy is stored within the fin structure itself (elastic deformation of upper and lower ribs 38, 40). By adjusting the size, shape and material used for upper and lower ribs 38, 40, the amount of energy stored in these upper and lower ribs 38, 40 and the angle of attack attained under soft and hard kicks can be controlled. In addition to controlling the angle of attack (which in itself increases efficiency), the stored energy in upper and lower ribs 38, 40 is returned at the end of the kick in the form of snapping back of blade 14. This snap has been observed as playing a significant role in increasing the efficiency of a diving fin. According to a preferred embodiment, upper and lower ribs 38, 40 are located at top and bottom of fin 10.

Ribs 38, 40 are configured to allow fin 10 to efficiently attain an initial angle of attack with minimal effort. In contrast, in conventional designs, these ribs are straight such that upon first bending the stretched fibers would immediately commence to pull hard, whereas the compressed fibers would tend to buckle because of excess material not knowing where to flow. By incorporating biasing system 16, material of blade 14 is preferably stiff, yet still reaches a good angle of attack under various loads.

One source of energy loss in kicking a fin is the amount of water that (during the movement of fin 10 through the water) instead of being pushed back by blade 14, "spills over" the sides of blade 14. Such "spillover" is typically caused by high pressure fluid on one side of blade 14 spilling over the side of blade 14 to the low pressure side. The difference in pressure multiplied by the cross-sectional area of blade 14 provides the thrust that pushes the swimmer forward. As such, spillover reduces the amount of thrust generated by fin 10. According to a preferred embodiment, spillover is reduced by having a stiffer blade, controlling flexing of blade 14 by biasing system 16, providing inner and outer flow channels 30, 32 for improved water flow, and providing outer ribs 22 with a profile better designed to retain water in inner and outer flow channels 30, 32.

According to an exemplary embodiment, outer channels 32 are configured to channel water across blade 14 and reduce spillover. According to a preferred embodiment, the surface on either side of foot pocket 12 presents a reduced or minimal cross section to the water so a reduced minimal resistance to its flow over it. As shown in FIG. 1, outer ribs 22 do not directly join to the foot pocket 12, thereby an "inlet" 42 is formed at the upstream end of outer channel 32 to allow water to flow into channels 32. By providing inlet 42 with reduced cross-section, destruction and disruption to the water flowing into and through outer channels 32 are reduced, turbulence and spillover are reduced, and laminar flow is increased.

Also, outer ribs 26 project from blade 14 further than conventional designs. Preferably, outer ribs 26 extend from blade 14 at least about ¼ inches. According to a particularly preferred embodiment, outer ribs 26 extend from blade 14 between about ½ inch and about 1 inch. Alternatively, the ribs extend from blade by an amount appropriate to reduce spill over effects for the swimming style. As such, outer ribs 26 have the function of limiting the "escape" of high-pressure flow (under the fin 10) around the sides of blade 14 to the area of low pressure (over the fin 10).

It is also important to note that the construction and arrangement of the elements of the swim fin with improved angle of attack and water flow characteristics as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the energy accumulations may have any of a variety of shapes or configuration. Also, blade 14 may be made of a flexible material (rather than the preferred stiff material) and still incorporate the advantages of the biasing system. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A fin for use by a swimmer and having a first end, a second end opposite the first end, and right and left sides extending between the first and second ends, the fin comprising:

a foot pocket located at the first end and adapted to receive a foot of the swimmer;

a blade extending from the foot pocket toward the second end and having a major surface between the right side and the left side;

a biasing system including at least one rib configured to deform as the blade bends;

wherein at least a portion of the at least one rib alternately extends between the right side and the left side so that the blade bends within a narrow range of angles of attack under a wide range of loads.

2. The fin of claim 1 wherein the at least a portion of the at least one rib is located adjacent an axis where the flexing of the fin substantially occurs.

3. The fin of claim 2 wherein the at least one rib is integrally molded with at least one of the blade and foot pocket.

4. The fin of claim 2 wherein the at least one rib is generally perpendicular to the blade.

5. The fin of claim 4 wherein the at least a portion of the at least one rib has a sinusoidal shape.

6. The fin of claim 2 wherein the axis is at the interface of the blade and foot pocket.

7. The fin of claim 1 wherein the biasing system is configured to store and release energy during use of the fin.

8. The fin of claim 1 wherein the blade comprises outer ribs and one or mare inner ribs defining one or more flow channels, the outer ribs being not connected to the foot pocket so that the upstream end of the one or more flow channels has a planar leading edge.

9. The fin of claim 1 wherein the wide range of loads comprises a light kick, a medium kick and a hard kick.

10. The fin of claim 1 further comprising at least one flow channel defined by the blade, an outer rib extending from the blade, and an inner surface extending from the blade.

11. The fin of claim 10 wherein the flow channel includes an inlet defined by the outer rib, the inner surface, and a leading edge, the leading edge extending between the foot pocket and the outer rib, and configured to provide substantially laminar flow of water through the flow channel.

12. The fin of claim 11 wherein the outer rib is not directly connected to the foot pocket.

13. The fin of claim 12 wherein the flow channel includes an inlet defined by the outer rib, the surface, and a leading edge, the leading edge extends a lesser distance from the blade than the outer rib.

14. The fin of claim 12 wherein the outer rib is sized to reduce spillover.

15. A fin for use by a swimmer and having a first end, a second end opposite the first end, and right and left sides extending between the first and second ends, the fin comprising:

a foot pocket located at the first end and adapted to receive a foot of the swimmer;

a blade extending from the foot pocket toward the second end and having a major surface between the right side and the left side and configured to flex about an axis;

a biasing system configured to control the angle of attack of the blade, the biasing system comprising at least one rib having at least a portion that extends back and forth between the right side and the left side generally parallel with the major surface of the blade and located adjacent to the axis.

16. The fin of claim 15 wherein at least one rib has a generally sinusoidal waveform shape that is generally parallel to the major surface of the blade.

17. The fin of claim 16 wherein the sinusoidal shaped rib has a period of about one inch.

18. The fin of claim 16 wherein the sinusoidal shaped rib is configured to convert flexing of the blade into thrust.

19. The fin of claim 16 wherein the sinusoidal shaped rib has a spring constant.

20. The fin of claim 16 wherein the sinusoidal shaped rib is at least partially located between the foot pocket and the blade.

21. The fin of claim 20 wherein the sinusoidal shaped rib is located on the top and bottom of the fin.

22. The fin of claim 16 wherein the sinusoidal rib is integrally molded with at least one of the blade and foot pocket.

23. The fin of claim 15 wherein the blade comprises a pair of outer ribs and one or more inner ribs, wherein the inner ribs are coupled to the the at least one rib.

24. The fin of claim 15 further comprising at least one flow channel defined by the blade, an outer rib extending from the major surface of the blade.

25. The fin of claim 24 wherein the flow channel includes an inlet defined by the outer rib, the surface, and a leading edge, the leading edge extending between the foot pocket and the outer rib, and configured to provide substantially laminar flow of water through the flow channel.

26. The fin of claim 24 wherein the outer rib is not directly connected to the foot pocket.

27. The fin of claim 24 wherein the flow channel includes an inlet defined by the outer rib, the surface, and a leading edge, the leading edge extends a lesser distance from the blade than the outer rib.

28. The fin of claim 24 wherein the outer rib is sized to reduce spillover.

29. A fin for use by a swimmer, the fin comprising:

a foot pocket adapted to receive a foot of the swimmer;

a blade extending from the foot pocket;

means for controlling flexing of the blade wherein means for controlling flexing of the blade includes one or more ribs that have a sinusoidal waveform shape generally parallel relative to a major surface of the blade.

30. The fin of claim 29 wherein the one or more sinusoidal ribs are located proximate a flexing axis.

31. The fin of claim 30 wherein energy is stored in the one or more sinusoidal ribs by tension or compression of the ribs.

32. The fin of claim 29 wherein the means for controlling flexing of the blade stores energy by deforming the one or more sinusoidal ribs.

33. The fin of claim 32 wherein means for controlling the flexing of the blade converts the stored energy into thrust.

34. The fin of claim 29 wherein means for controlling the flexing of the blade comprises controlling an angle of attack of the blade.

35. A method of providing thrust from a kick by a swimmer, the method comprising:

providing a swim fin comprising a foot pocket, a blade, and one or more ribs that projects generally perpendicular from the blade and include at least a portion that alternately extends toward a right side and a left side of the blade;

bending the blade relative to the foot pocket about an axis;

controlling the bending of the blade by providing varying resistance by the at least a portion of the ribs.

36. The method of claim 35 further comprising storing energy in the at least a portion of the one or more ribs, and converting the stored energy into thrust.

37. The method of claim 35 wherein the one or more ribs are configured to stretch and compress as blade bends during use.

38. The method of claim 35 wherein the one or more ribs are located on the top and bottom of the fin so that bending of the blade stretches and compresses the one or more ribs.

39. The method of claim 35 wherein controlling the bending comprises providing increased resistance for increased amounts of bending.

* * * * *